US009788621B2

(12) United States Patent
Kim

(10) Patent No.: US 9,788,621 B2
(45) Date of Patent: Oct. 17, 2017

(54) CASE HAVING STANDING LEG FOR ELECTRONIC DEVICE

(71) Applicant: SPIGEN KOREA CO., LTD., Seoul (KR)

(72) Inventor: Dae-Young Kim, Seoul (KR)

(73) Assignee: SPIGEN KOREA CO., LTD., Geumcheon-Gu, Seoul (KR)

( * ) Notice: Subject to any disclaimer, the term of this patent is extended or adjusted under 35 U.S.C. 154(b) by 0 days.

(21) Appl. No.: 15/362,737

(22) Filed: Nov. 28, 2016

(65) Prior Publication Data

US 2017/0150792 A1 Jun. 1, 2017

Related U.S. Application Data

(60) Provisional application No. 62/260,310, filed on Nov. 26, 2015.

(51) Int. Cl.

| | |
|---|---|
| ***A45C 11/00*** | (2006.01) |
| ***A45C 13/00*** | (2006.01) |
| ***A45F 5/00*** | (2006.01) |

(52) U.S. Cl.

CPC ..... *A45C 11/00* (2013.01); *A45C 13/002* (2013.01); *A45F 5/00* (2013.01); *A45C 2011/001* (2013.01); *A45C 2011/002* (2013.01); *A45C 2011/003* (2013.01); *A45C 2200/15* (2013.01)

(58) Field of Classification Search

CPC . A45C 11/00; A45C 13/002; A45C 2011/001; A45C 2011/002; A45C 2011/003; A45C 2200/15; A45F 5/00; F16M 11/00; F16M 11/06; F16M 11/10; F16M 13/00; F16M 13/005; G06F 1/16; G06F 1/1626; G06F 1/1633; G06F 1/1637; G06F 1/166; H05K 5/02; H05K 5/0204;

(58) Field of Classification Search

CPC ..... H05K 5/226; A47G 29/00; H04B 1/3888; H04M 1/02; H04M 1/0206

USPC ..... 206/320; 248/176.3, 454–456, 673–688; 361/679.01, 679.02, 679.03, 361/679.55–679.59; 455/90.3, 575.1, 455/575.8

See application file for complete search history.

(56) References Cited

U.S. PATENT DOCUMENTS 8,243,432 B2 * 8/2012 Duan ..... H04M 1/04 361/679.59
8,456,834 B2 * 6/2013 Zhu ..... G11B 33/025 361/679.55

(Continued)

FOREIGN PATENT DOCUMENTS

CA 2826540 A1 * 3/2014 ..... H01R 1/026

*Primary Examiner* — Bryon Gehman

(74) *Attorney, Agent, or Firm* — East West Law Group; Heedong Chae

(57) ABSTRACT

A case having a standing leg includes a soft protective cover, a hard protective frame, a standing leg, and a spring which biases the standing leg to an open position. An opening formed on the hard protective frame so that the standing leg fits in the opening. The standing leg and the soft protective cover are constructed to be magnetically attractable to each other. In a closed position of the standing leg, a magnetic force between the standing leg and the soft protective cover is stronger than a tensile force of the spring to maintain the standing leg's closed position, and in the open position of the standing leg, the tensile force is stronger than the magnetic force to maintain the standing leg's open position. In the alternative embodiment, the case includes a kickstand which is secured between the soft protective cover and the hard protective frame.

20 Claims, 13 Drawing Sheets

(56) References Cited

U.S. PATENT DOCUMENTS

| | | | | |
|---|---|---|---|---|
| 8,567,748 | B2 * | 10/2013 | Zhou | F16M 11/10 248/676 |
| 8,693,192 | B2 * | 4/2014 | Hsieh | H04M 1/04 361/679.59 |
| D706,254 | S | 6/2014 | Chang | |
| 8,897,033 | B2 | 11/2014 | Slipy et al. | |
| 8,922,996 | B2 * | 12/2014 | Yeh | H04M 1/0202 361/679.3 |
| 8,960,634 | B2 * | 2/2015 | Le Gette | F16M 11/04 248/163.1 |
| 8,978,883 | B2 * | 3/2015 | Gandhi | A45C 11/00 206/320 |
| 9,316,344 | B2 * | 4/2016 | Le Gette | F16M 11/041 |
| 9,470,358 | B2 * | 10/2016 | Le Gette | F16M 11/10 |
| 9,565,909 | B2 * | 2/2017 | Song | A45C 11/00 |
| 2010/0142130 | A1 | 6/2010 | Wang et al. | |
| 2011/0228458 | A1 | 9/2011 | Richardson et al. | |
| 2012/0088558 | A1 | 4/2012 | Song | |
| 2012/0199501 | A1 | 8/2012 | Le Gette et al. | |
| 2012/0217174 | A1 | 8/2012 | Ting | |
| 2013/0286623 | A1 | 10/2013 | Slipy et al. | |
| 2015/0244408 | A1 | 8/2015 | Chen | |
| 2016/0230925 | A1 * | 8/2016 | Le Gette | F16M 11/041 |

* cited by examiner

CASE HAVING STANDING LEG FOR ELECTRONIC DEVICE

CROSS-REFERENCE TO RELATED APPLICATIONS

This application claims priority to U.S. provisional patent application No. 62/260,310, filed Nov. 26, 2015, the disclosures of which are incorporated herein by reference in their entirety.

FIELD OF THE INVENTION

The present invention relates to a case having a soft protective cover, a hard protective frame, and a standing leg for an electronic device and, more particularly, to a smart phone case having a standing leg for propping up the smart phone case. The standing leg is pivoted with the hard protective frame of the case by a spring. Alternatively, the case further comprises a kickstand secured between the hard protective frame and the soft protective cover.

BACKGROUND OF THE INVENTION

Mobile electronic devices such as mobile phones, smart phones, tablet computers and the like are in wide use around the world. A user grips such a device in his hand or hands to use it and uses his fingers to use various applications of the device. However, while using the device, the user may accidentally drop the device thereby causing damage to the device. In addition, use of mobile electronic devices may cause hand, limb and back problems due to the physical stress of holding the electronic device for an extended period of time.

Users of mobile electronic devices use cases to protect their devices, and manufacturers have produced different types of cases to help the users keep their mobile devices safe. However, some of these cases do not allow a user to prop up the mobile device for hands-free viewing at a comfortable angle. Even if such function is allowed, the propping up structure is often complicated and inconvenient.

Therefore, to solve the above problems, there is a need for a case having an easy-to-use standing leg for an electronic device constructed in a simple and durable structure. This invention is directed to solve these problems and satisfy the long-felt need.

SUMMARY OF THE INVENTION

The present invention contrives to solve the disadvantages of the prior art. The present invention provides a case having a standing leg for an electronic device such as a mobile phone, smart phone, tablet computer and the like, and, more particularly, to a standing leg pivoted not just with the hard protective frame of the case but also with the soft protective case of the case. The object of the present invention is to provide a case having a standing leg for an electronic device, including:

a soft protective cover for protecting the electronic device installed therein, covering a back portion of the electronic device; a hard protective frame, constructed to removably mount over the soft protective cover; a standing leg for propping up the electronic device; a spring for biasing the standing leg to an open position of the standing leg; and an opening formed on a back portion of the hard protective frame wherein the standing leg fits in the opening. The standing leg and the soft protective cover are constructed to be magnetically attractable to each other. In a closed position of the standing leg, a magnetic force between the standing leg and the soft protective cover is stronger than a tensile force of the spring to maintain the closed position of the standing leg, and in the open position of the standing leg, the tensile force of the spring is stronger than the magnetic force between the standing leg and the soft protective cover to maintain the open position of the standing leg. Additionally, the standing leg is constructed to rotate up to about a predetermined angle.

U.S. patent application Ser. No. 14/626,670, entitled "Case having Standing Leg for Electronic Devices" filed Feb. 19, 2015, discloses a case have a soft protective cover, a hard protective frame and a standing leg, the disclose of which is incorporated herein in its entirety.

Another object of the present invention is to provide a case having a standing leg for an electronic device, including: a soft protective cover for protecting the electronic device installed therein, covering a back portion of the electronic device; a hard protective frame, constructed to removably mount over the soft protective cover; a kickstand which comprises a standing leg for propping up the electronic device, a spring and a standing leg base wherein the standing leg is hinged on the standing leg base and the spring biases the standing leg to an open position of the standing leg; and an opening formed on a back portion of the hard protective frame wherein the kickstand fits in the opening. The standing leg and the standing leg base are constructed to be magnetically attractable to each other. In a closed position of the standing leg, a magnetic force between the standing leg and the standing leg base is stronger than a tensile force of the spring to maintain the closed position of the standing leg, and in the open position of the standing leg, the tensile force of the spring is stronger than the magnetic force between the standing leg and the standing leg base to maintain the open position of the standing leg. Additionally, the standing leg is constructed to rotate up to about a predetermined angle.

U.S. patent application Ser. No. 15/261,805, entitled "Kickstand for Protective Case" filed Sep. 9, 2016, discloses a stand-alone kickstand, the disclose of which is incorporated herein in its entirety.

The advantages of the present invention are: (1) the case of the present invention has a standing leg which conveniently opens and closes using magnetic force and a spring's tensile force; (2) in the alternative embodiment, the case includes a kickstand which can be secured between the soft protective cover and the hard protective frame; (3) the kickstand of the present invention utilizes a spring mechanism and a magnetic force to open and close a standing leg of the kickstand, and thus it is easy and convenient to use; (4) the kickstand of the present invention has a complicated structure but can be conveniently and effectively manufactured; (5) the soft protective cover, hard protective frame and standing leg are very easy to assemble and the standing leg is easy to replace; (6) the surface of the standing leg is flush with the surface of the hard protective frame when the standing leg is in a closed position, and the appearance and finish are stylish; (7) the standing leg can be opened easily and conveniently by using a fingernail; and (8) the case is constructed to be slim and compact despite the presence of the standing leg or the kickstand.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
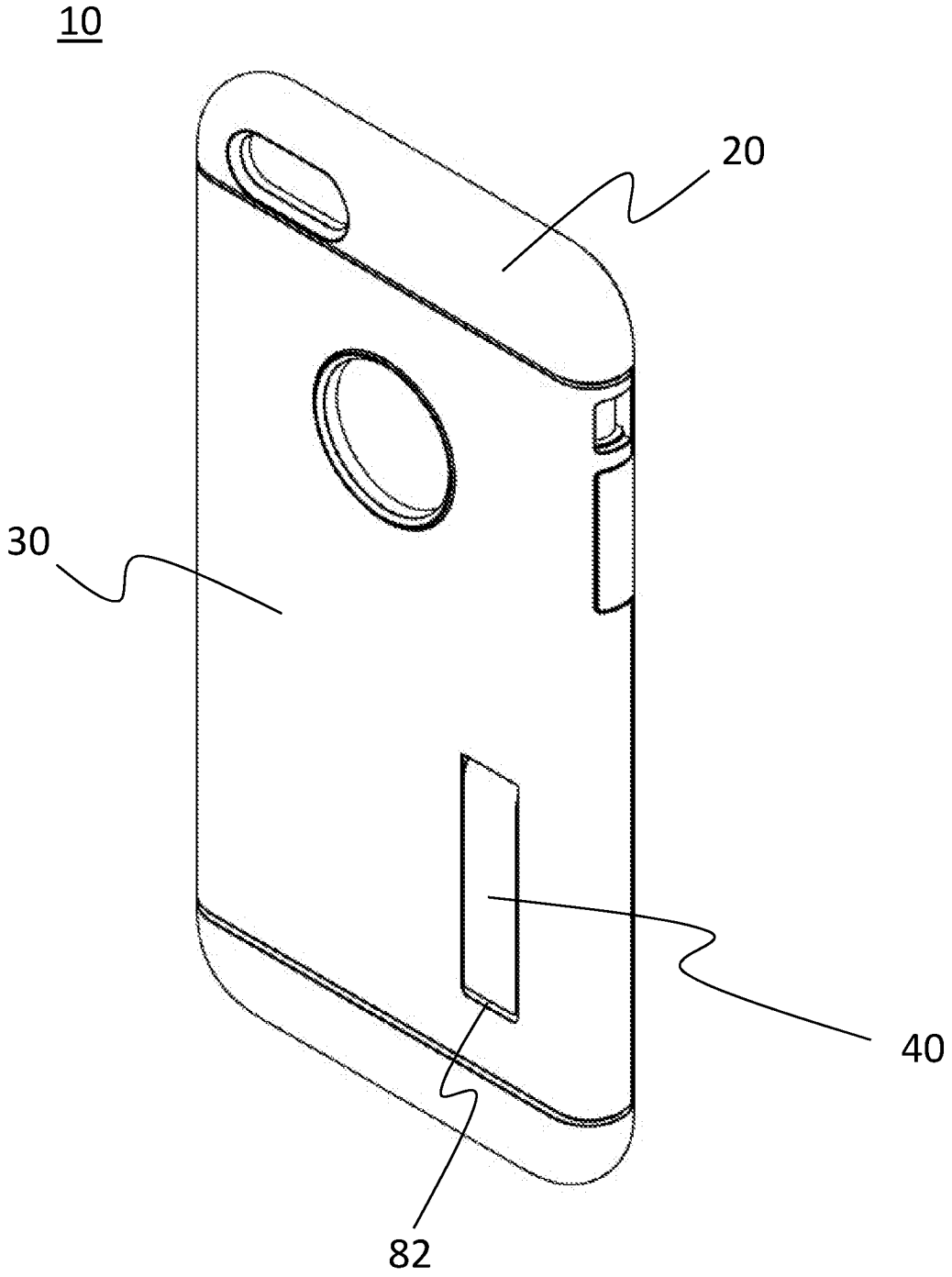
FIG. 1 shows a perspective view of a case having a standing leg according to one embodiment of the present invention.
Figure 2:
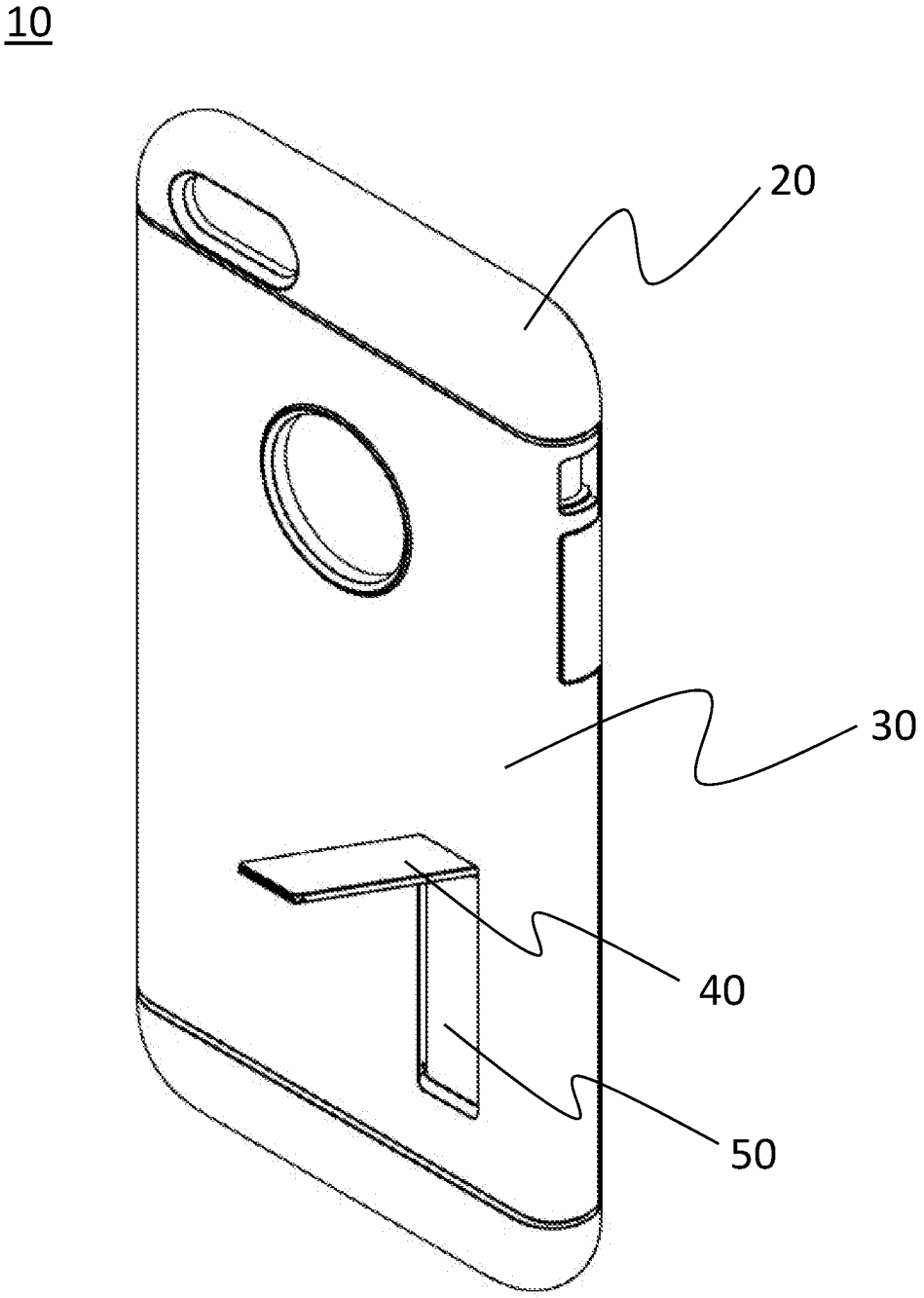
FIG. 2 shows a perspective view of the case with the standing leg in an open position according to the present invention.
Figure 3:
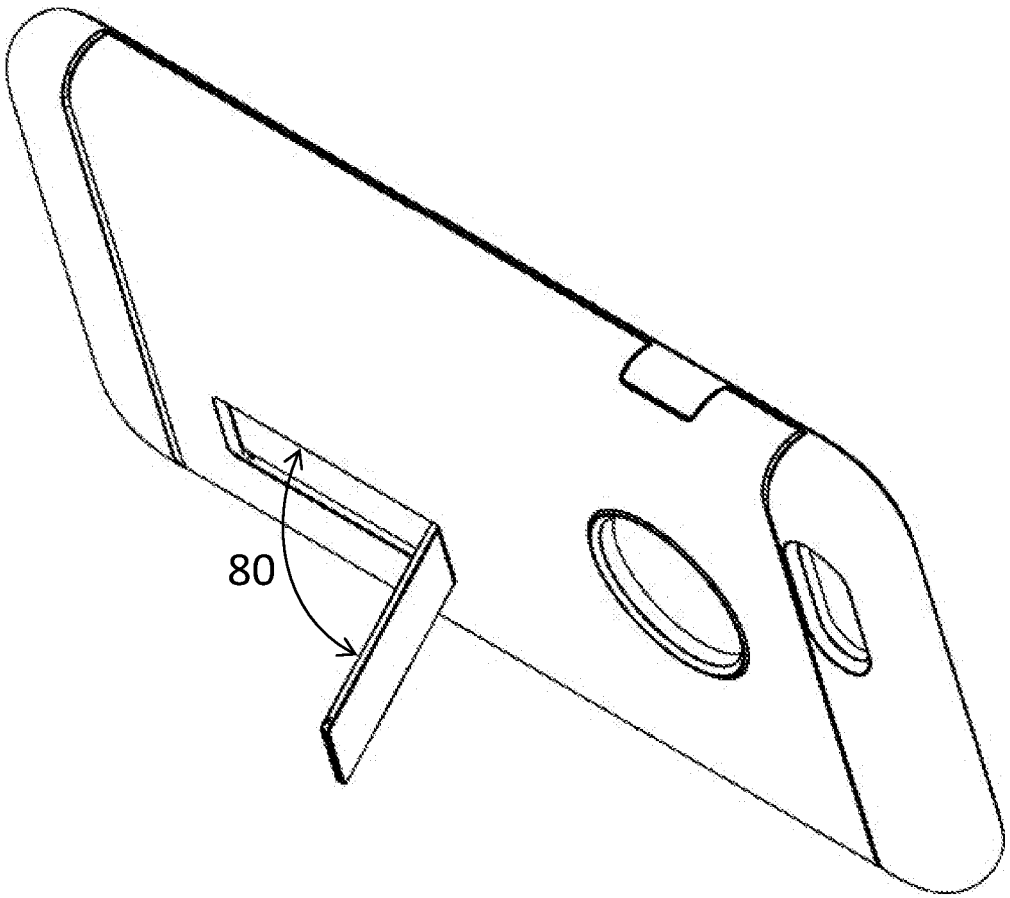
FIG. 3 shows another perspective view of the case with the standing leg open to prop up the case and an electronic device therein in a landscape orientation.
Figure 4:
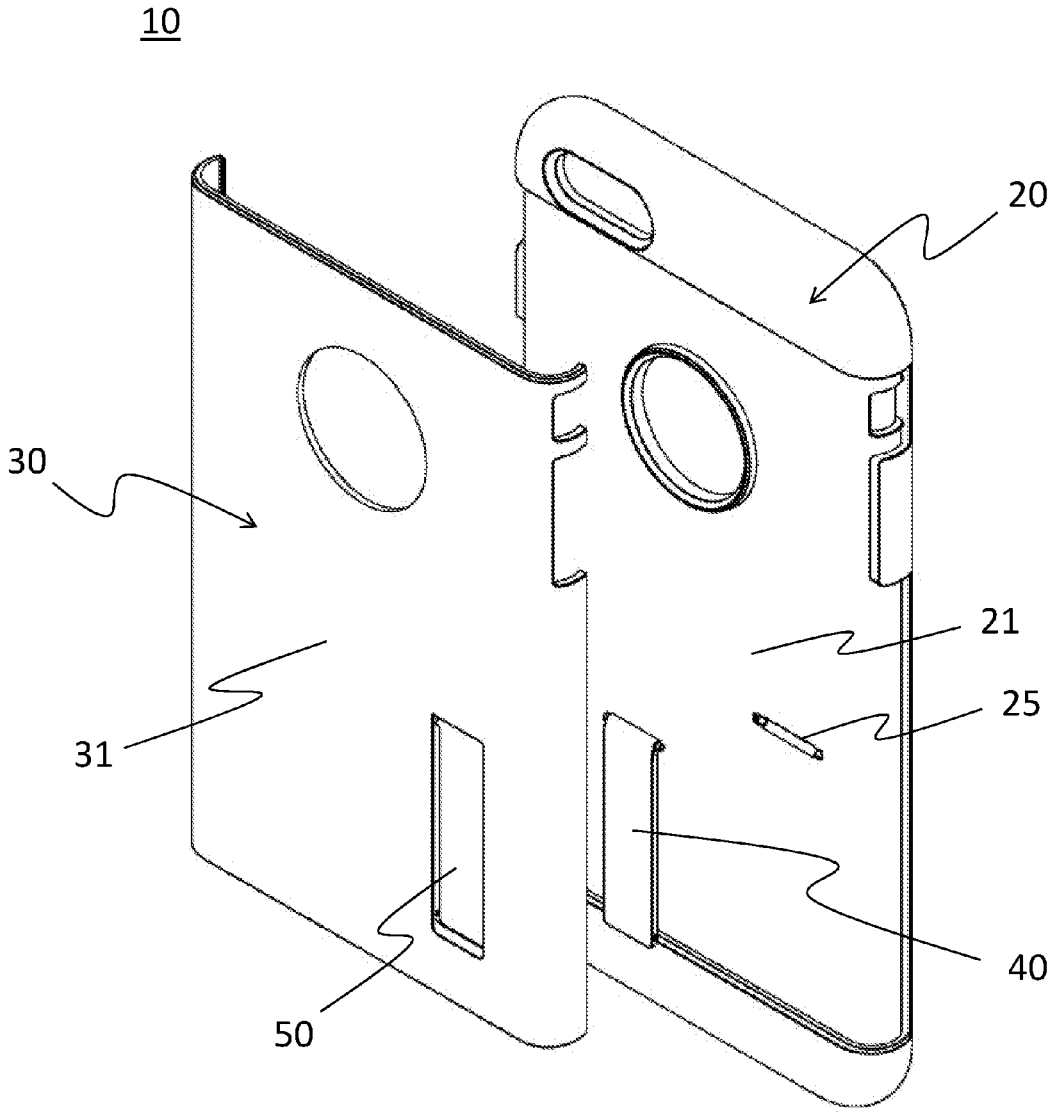
FIG. 4 shows an exploded view of the case having a soft protective cover, a hard protective frame and a standing leg according to the present invention.

FIG. 1 shows a perspective view of a case 10 having a standing leg 40 and FIG. 2 shows the case 10 when the standing leg 40 is in an open position. FIG. 3 shows the case 10 when the standing leg 40 is in an open position to prop up the case 10 and an electronic device 100 (not shown) therein in a landscape orientation. In addition, FIG. 4 shows an exploded view of the case 10 having a soft protective cover 20, a hard protective frame 30 and a standing leg 40 according to one embodiment of the present invention. The electronic device may be a mobile phone, smart phone, tablet computer, MP3 player, personal digital assistant or the like.

The case 10 of the present invention, having a standing leg 40 for an electronic device 100, includes a soft protective cover 20, a hard protective frame 30, and a standing leg 40. The soft protective cover 20 protects the electronic device 100 installed therein and covers a back portion 110 of the electronic device 100. The hard protective frame 30 is configured to removably mount over the soft protective cover 20 and the standing leg 40 props up the electronic device. An opening 50 is formed on a back portion 31 of the hard protective frame 30 and the standing leg 40 fits in the opening 50. Furthermore, the standing leg 40 is configured to rotate up to about a predetermined angle 80.

In a preferred embodiment, the soft protective cover 20 substantially covers the entire electronic device 100 (not shown) except for the screen side or front portion and providing cutout portions to allow for access to certain portions of the electronic device such as a camera lens, various ports, switches, and the like.

When the standing leg 40 is in an open position, the case 10 props up the electronic device 100 on a flat surface at a preferred viewing angle.

The opening 50 is sized to receive the standing leg 40 The standing leg 40 is rotatable from a closed position in which it is received in the opening 50 to an open position in which the standing leg 40 is rotated about the predetermined angle 80 so that the electronic device 100 may rest on a surface at a preferred viewing angle.

The standing leg 40 is pivoted with the soft protective cover 20 or the hard protective frame 30. Preferably, the standing leg 40 is pivoted with both of the soft protective cover 20 and the hard protective frame 30. Alternatively, the standing leg 40 may be pivoted either with the soft protective cover 20 or with the hard protective frame 30.

Figure 5:
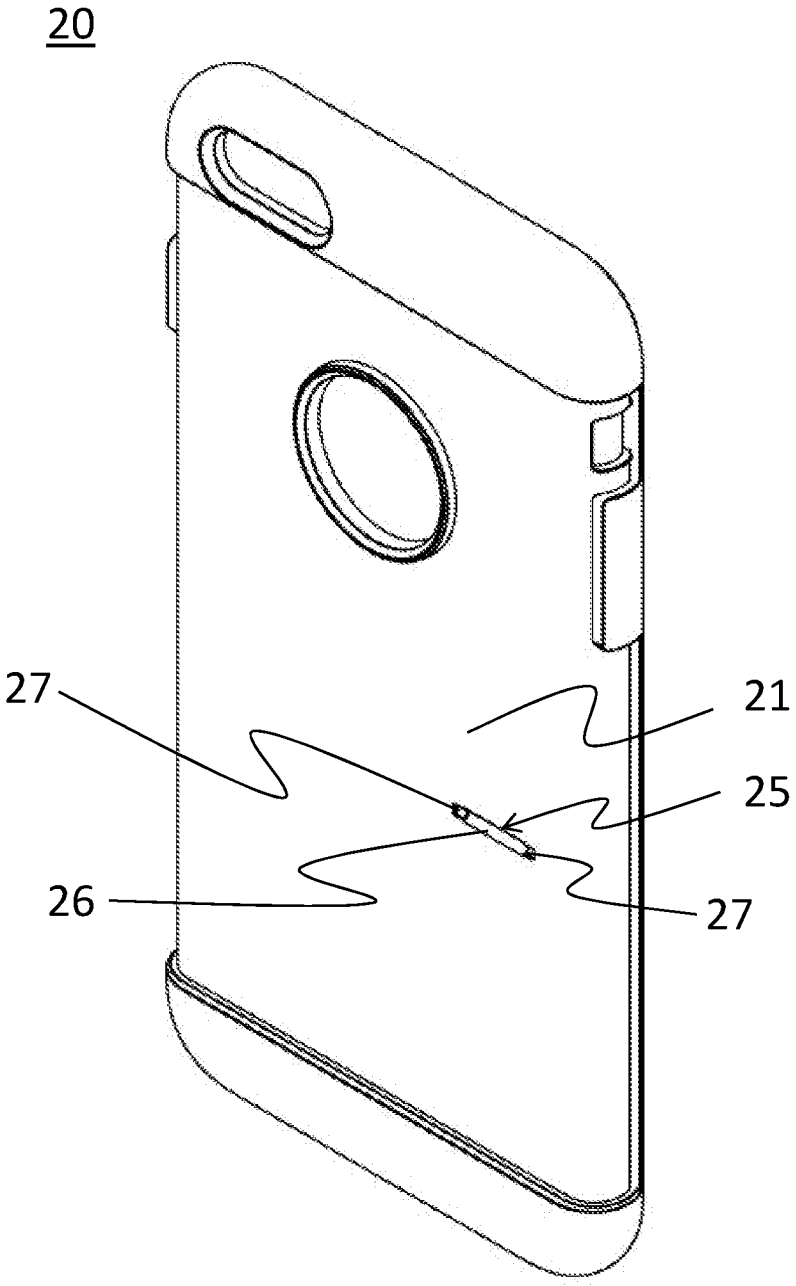
FIG. 5 shows a perspective view of the soft protective cover.
Figure 6:
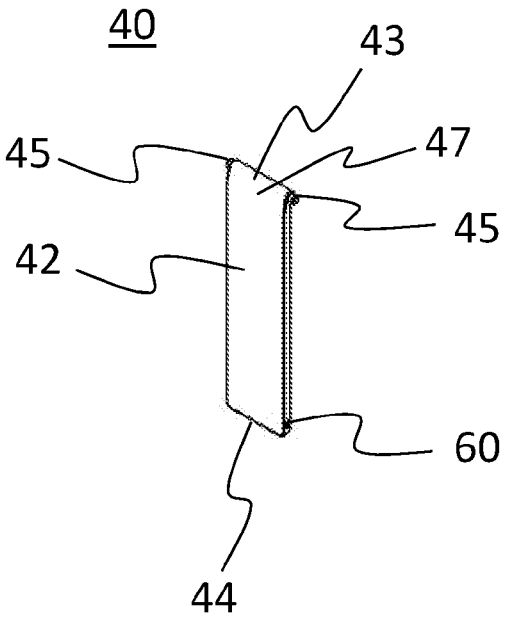
FIG. 6 shows a perspective view of the standing leg.
Figure 7:
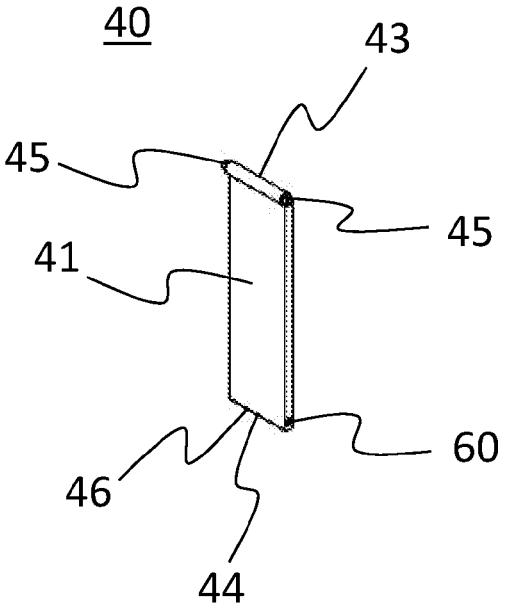
FIG. 7 shows another perspective view of the standing leg.
Figure 8:
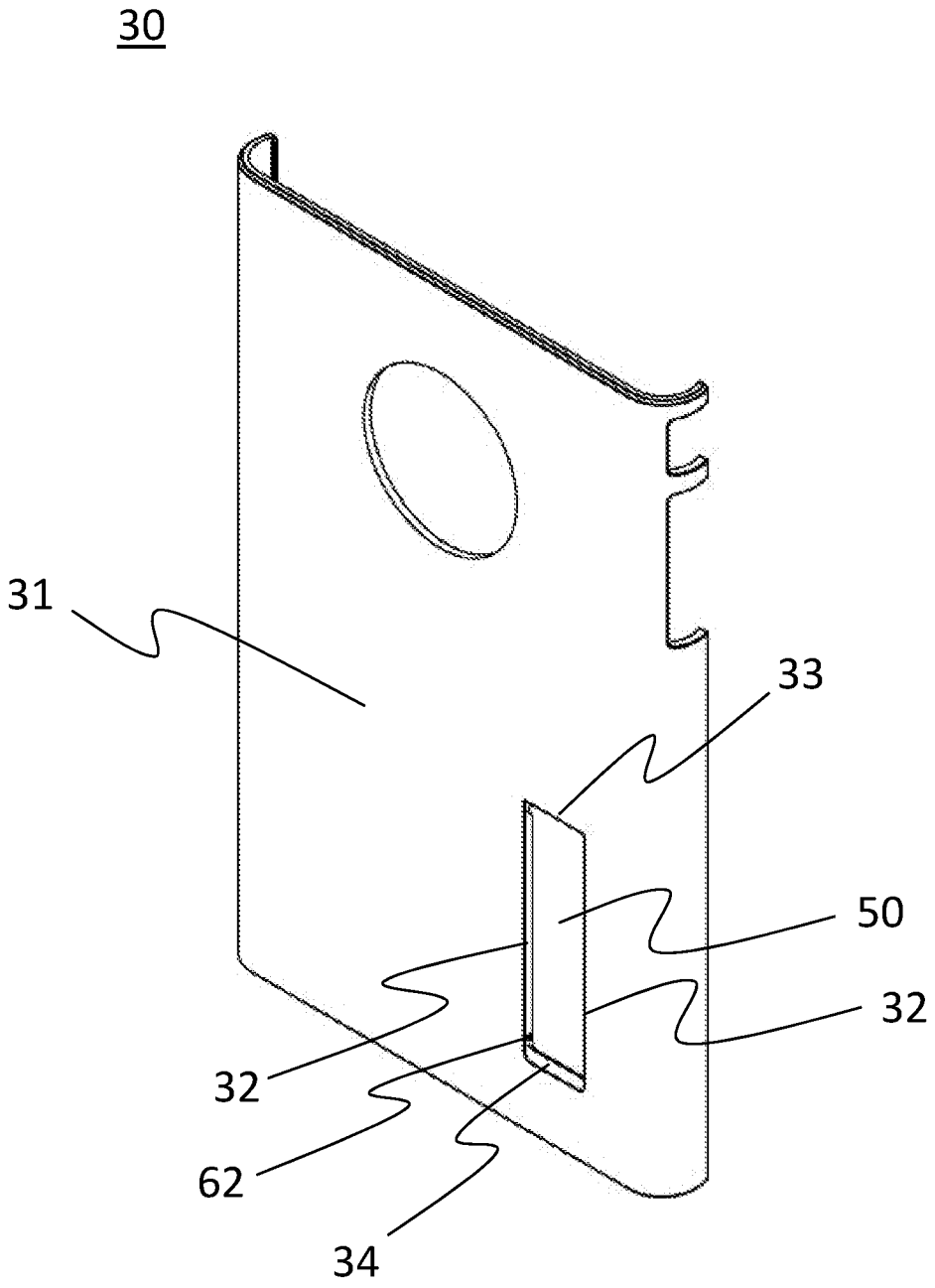
FIG. 8 shows a perspective view of the hard protective frame.
Figure 9:
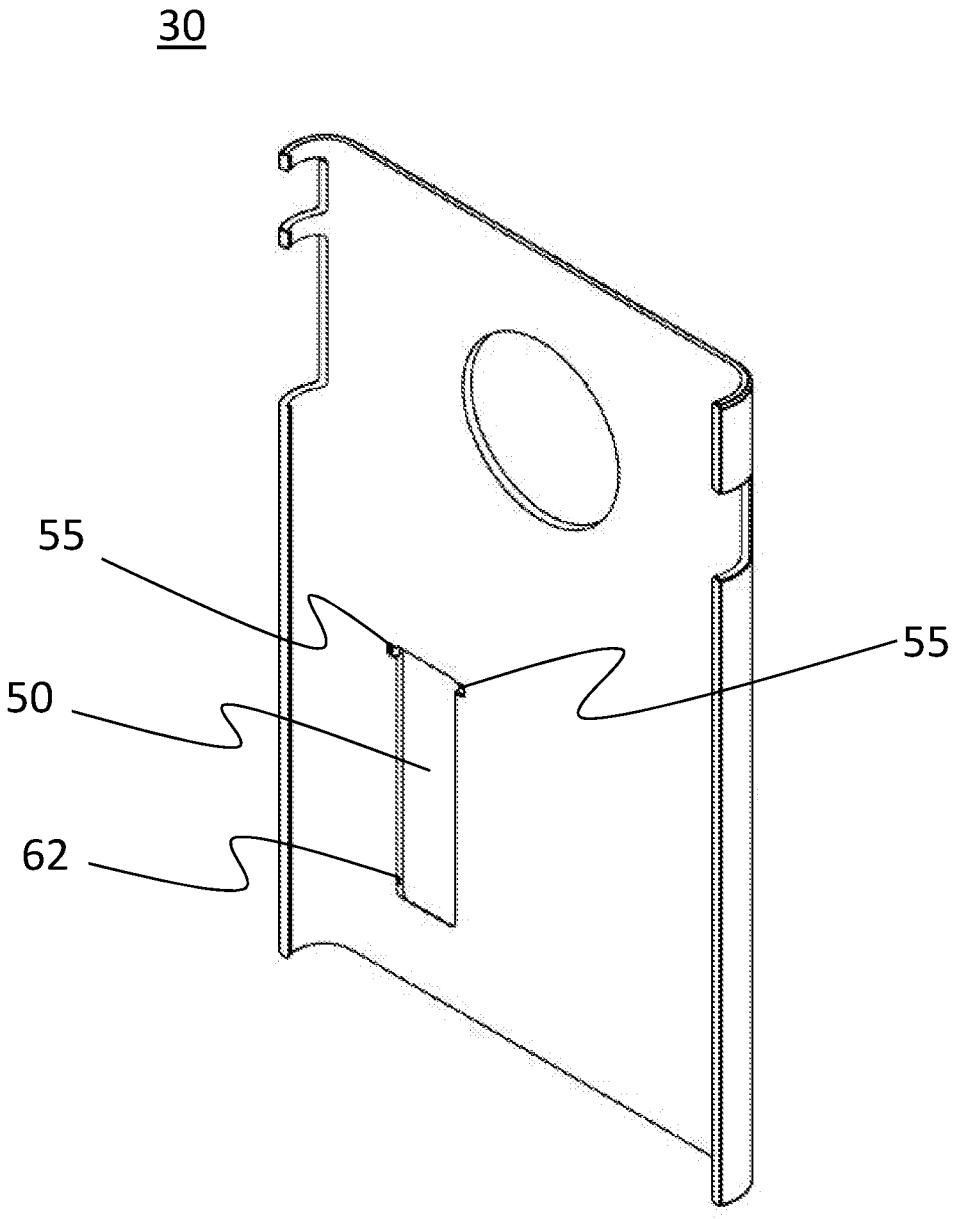
FIG. 9 shows another perspective view of the hard protective frame.

FIG. 5 shows a perspective view of the soft protective cover 20 and FIGS. 6 and 7 show perspective views of the standing leg 40. In addition, FIGS. 8 and 9 show perspective views of the hard protective frame 30.

The standing leg 40 includes a pivoting end 43 and the soft protective cover 20 includes a pivot groove 25 formed on a back portion 21 of the soft protective cover 20. In addition, the pivoting end 43 includes projections 45 formed on both ends of the pivoting end 43 and the pivoting groove 25 receives the projections 45. In addition to the projections 45, the pivoting end 43 may fit in the pivoting groove 25. The projections 45 define a pivot axis for the standing leg 40.

The hard protective frame 30 may further include pivoting recesses 55 formed on side walls 32 of the opening 50 in that the pivoting recesses 55 receives the projections 45.

As in FIG. 5, the pivoting groove 25 may include a body portion 26 and two end portions 27 such that the two projections 45 fit in the end portions 27 and the pivoting recesses 55. Preferably, an end portion 27 and a pivoting recess 55 form a cylinder to receive a cylindrical projection 45 therein. In addition, the pivoting end 43 pivots in the pivoting groove 25. The pivoting groove 25 is made of soft material and helps smooth rotation of the standing leg 40.

Preferably, the pivoting groove 25 is rounded or circular and a diameter of the body portion 26 is greater than a diameter of the end portions 27.

The hard protective frame 30 is configured to removably mount over the soft protective cover 20, and when the hard protective frame 30 mounts over the soft protective cover 20, the standing leg 40 is placed within the opening 50 and the projections 45 are received in the pivoting recesses 55. Then, the projections 45 act as a hinge for the standing leg 40. In this manner, the standing leg 40 can be easily replaced should it get damaged or worn down in the future.

The projections 45 may be formed on both ends of the pivoting end 43 by molding the standing leg 40 and the projections 45 together. Alternatively, a shaft may be inserted into a shaft through-hole (not shown) formed on the pivoting end 43 of the standing leg 40.

The standing leg 40 includes an inner surface 41 and an outer surface 42, and the hard protective frame 30 includes a pivoting end wall 33, two side walls 32 and a distal end wall 34. As shown in FIG. 8, the pivoting end wall 33, two side walls 32 and distal end wall 34 form the opening 50.

Figure 10:
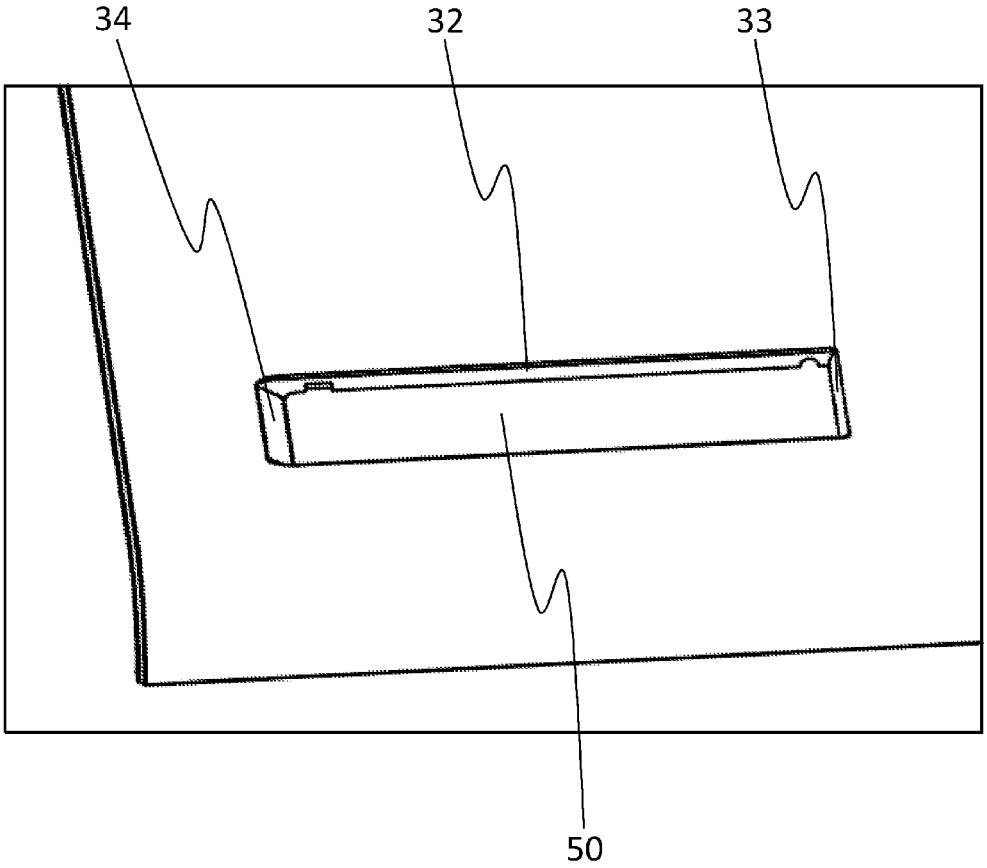
FIG. 10 shows a partial perspective view of the hard protective frame showing the opening of the hard protective frame.

FIG. 10 shows a partial perspective view of the hard protective frame 30 showing the opening 50 of the hard protective frame 30.

The standing leg 40 is configured to rotate about the predetermined angle 80 until a contact part 47 of the outer surface 42 contacts the pivoting end wall 33, the standing leg being prevented from rotation by the pivoting end wall 33. Preferably, the predetermined angle 80 is more than 90 degrees. As in FIG. 3, if the predetermined angle 80 is more than 90 degrees, the standing leg 40 does not rotate back toward the opening 50 while propping up the case 10 and the electronic device 100 (not shown) because of the weight of the case and the electronic device 100. The weight presses the standing leg 40 to rotate away from the opening 50.

Preferably, the contact part 47 of the standing leg 40 is sloped and the pivoting end wall 33 is sloped such that the contact part 47 is in planar contact with the pivoting end wall 33 when the standing leg 40 is rotated about the predetermined angle 80. Such planar contact provides wider contact area than linear or point contact, and thus, scratch or damage to the standing leg 40 or the pivoting end wall 33 can be minimized. In addition, the pivoting end wall 33 can provide stable and reliable support to the standing leg 40 in an open position. In addition, by adjusting the slopes of the pivoting end wall 33 and the contact part 47, the predetermined angle 80 can be adjusted.

A mating protrusion 60 may be formed on the standing leg 40 and a mating cavity 62 may be formed on the side wall 33 such that the mating protrusion 60 is mated with the mating cavity 62. Alternatively, a mating protrusion 60 may be formed on the side wall 33 and a mating cavity 62 may be formed on the standing leg 40 such that the mating protrusion 60 is mated with the mating cavity 62. Preferably, there are two mating protrusions 60 and two mating cavities 62 on opposite sides of the standing leg 40. In a closed position, the standing leg 40 is held in place by the mating between the mating protrusion 60 and mating cavity 62.

When the standing leg 40 is in a closed position, substantial portion of the inner surface 41 of the standing leg 40 is in contact with the back portion 21 of the soft protective case 20. The back portion 21 of the soft protective case 20 is soft and thus, scratch or damage to the standing leg 40 is prevented. Furthermore, when the standing leg 40 is in a closed position, the outer surface 42 of the standing leg 40 is substantially flush with the back portion 31 of the hard protective frame 30 and this construction provides a stylish look and feel of the case 10.

The distal end wall 34 may be sloped and there may be a gap 82 between the distal end wall 34 and a distal end 44 of the standing leg 40 for easy insertion of a user's fingernail into the gap to open the standing leg 40. A user may insert his fingernail into the gap 82 and open the standing leg 40 locked by the mating between the mating protrusion 60 and mating cavity 62. Then, the user may rotate the standing leg 40 about the predetermined angle 80 until such rotation is stopped by the pivoting end wall 33.

A recess or a slope 46 may be formed on the distal end 44 of the standing leg 40 for easy insertion of a user's fingernail into the gap 82 to open the standing leg 40. In addition to the sloped distal end wall 34, the recess or slope 46 formed on the distal end 44 makes the gap 82 bigger for easy insertion of a fingernail.

Because of this construction for the gap 82, the standing leg 40 does not require a knob, lever or handle to open it. Without a knob, lever or handle, the standing leg 40 and the case 10 can be designed more stylish.

An emblem, a trademark, a slogan, or an insignia may be formed on an inner surface 41 of the standing leg 40. Additionally, an emblem, a trademark, a slogan, or an insignia may be formed on a back portion 21 of the soft protective case 20 corresponding to a location of the opening 50. An emblem, a trademark, a slogan, or an insignia may be formed on an outer surface 42 of the standing leg 40 as well.

The inner surface 41 and the back portion 21 of the soft protective case 20 corresponding to a location of the opening 50 may be patterned to provide additional grip as well as aesthetic design.

The soft protective cover 20 is made of a soft material and the hard protective frame 30 is made of a hard material. Preferably, the soft protective cover 20 is made of an elastic material.

The soft material may be an elastomeric resilient material, for example, thermoplastic polyurethane (TPU) or other thermoplastic elastomers having a similar durometer hardness. The hard material may include a substantially rigid material, for example, polycarbonate (PC) or a similarly rigid material having a similar durometer hardness greater than the durometer hardness of the soft material.

The hard protective frame 30 may be made of polyvinyl chloride (PVC), titanium, aluminum, graphite composite, metal, plastic or other suitable materials. Preferably, the soft protective cover 20 is made of thermoplastic polyurethane and the hard protective frame 30 is made of polycarbonate.

Figure 11:
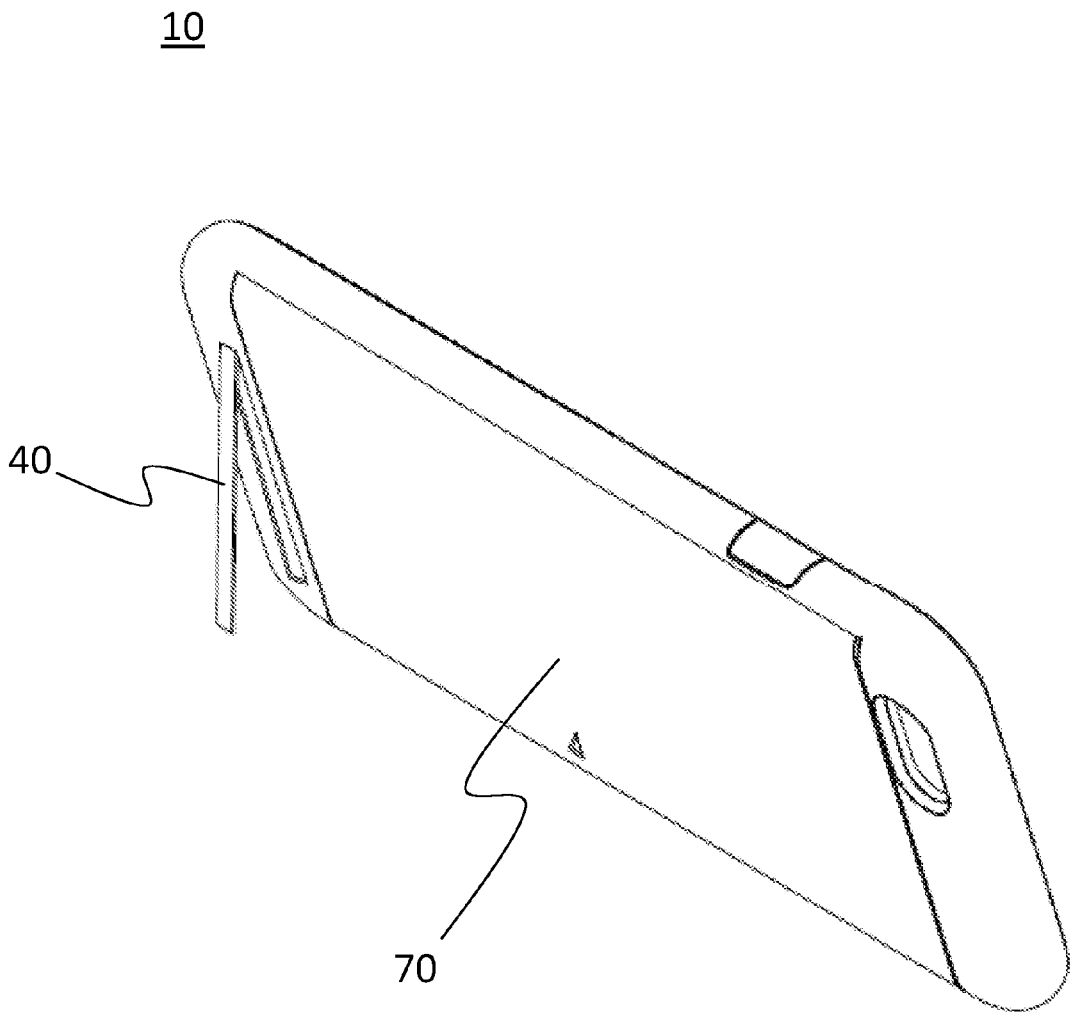
FIG. 11 shows a perspective view of the case with a standing leg open to prop up the case according to another embodiment of the present invention.
Figure 12:
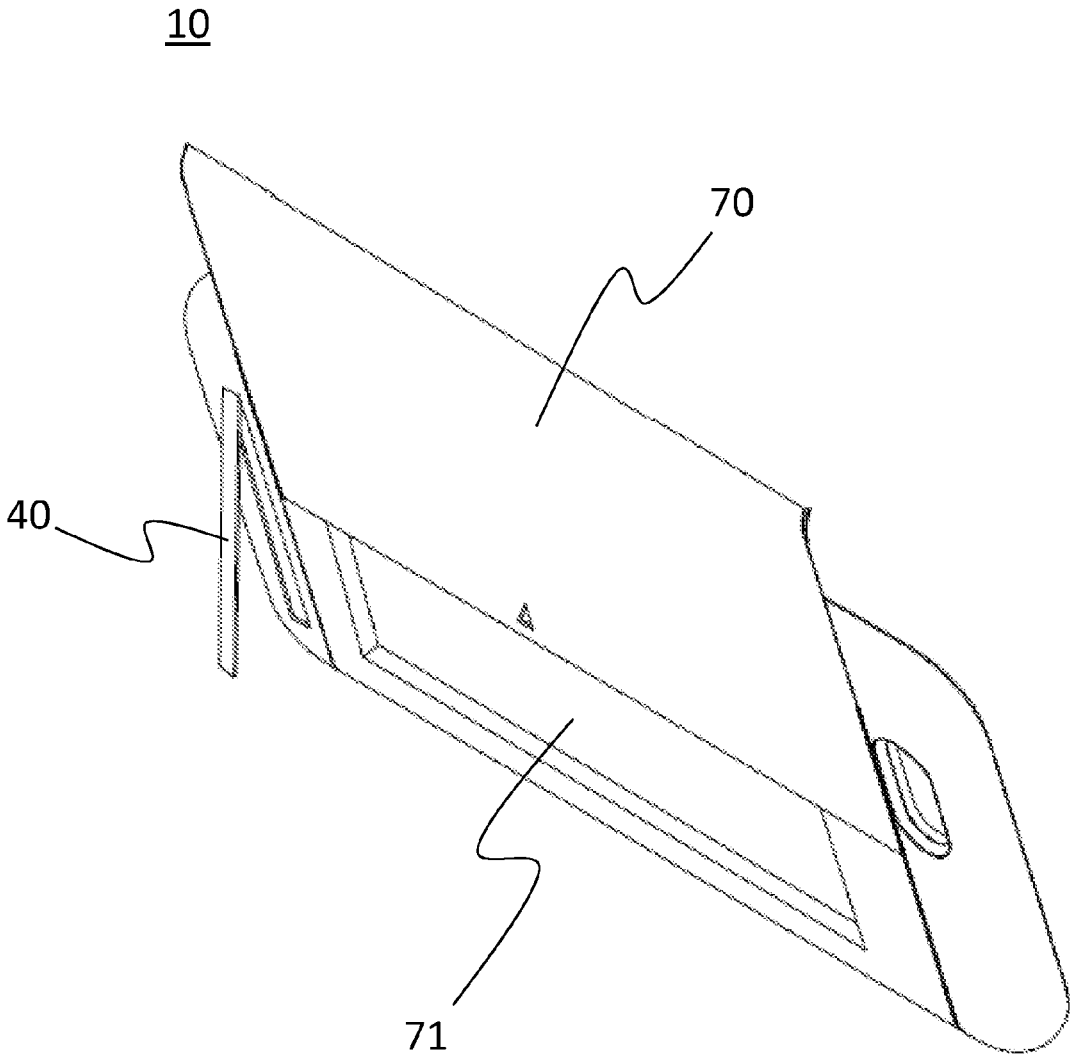
FIG. 12 shows another perspective view of the case with a standing leg open to prop up the case according to another embodiment of the present invention.

FIG. 11 shows a perspective view of the case with a standing leg 40 open to prop up the case 10 in a landscape orientation according to another embodiment of the present invention and FIG. 12 shows the case when the cover 70 is open.

A credit card storage space 71 is formed between the soft protective cover 20 and the hard protective frame 30. The cover 70 opens and closes the storage space 71. The standing leg 40 is pivoted with an opening 50 formed on the hard protective frame 30, preferably next to the cover 70. As in FIG. 12, even if the cover 70 is open, the case 10 can stand by the support of the standing leg 40.

Here, the predetermined angle 80 can be any angle, but preferably smaller than 90 degrees. By adjusting the slopes of the pivoting end wall 33 and the contact part 47, the predetermined angle 80 can be adjusted. For the predetermined angle 80 to be smaller than 90 degrees, the angle between the pivoting end wall 33 and the bottom of the soft protective cover 20 corresponding to the opening 50 needs to be a sharp one, smaller than 90 degrees.

FIGS. 5, 10 and 11 show the case 10 propped up in a landscape orientation. However, the present invention also covers the case 10 propped up in a portrait orientation.

In the alternative embodiment of the present invention, the case 10 may further include a spring for biasing and urging the standing leg 40 to the open position of the standing leg. The standing leg 40 may have a shaft so that the spring is positioned about the shaft.

In addition, the standing leg 40 may be constructed to be magnetically attractable toward a direction of the electronic device to the closed position of the standing leg 40.

The case 10, having a standing leg 40 for an electronic device, includes: a soft protective cover 20 for protecting the electronic device installed therein, covering a back portion of the electronic device; a hard protective frame 30, constructed to removably mount over the soft protective cover 20; a standing leg 40 for propping up the electronic device; and an opening 50 formed on a back portion of the hard protective frame 30 wherein the standing leg 40 fits in the opening 50. The standing leg 40 and the soft protective cover 20 are constructed to be magnetically attractable to each other. In addition, the standing leg 40 is constructed to rotate up to about a predetermined angle.

In another embodiment, the case 10 having a standing leg 40 for an electronic device, includes: a soft protective cover 20 for protecting the electronic device installed therein, covering a back portion of the electronic device; a hard protective frame 30, constructed to removably mount over the soft protective cover 20; a standing leg 40 for propping up the electronic device; a spring for biasing the standing leg to an open position of the standing leg; and an opening 50 formed on a back portion of the hard protective frame 30 wherein the standing leg 40 fits in the opening 50. The standing leg 40 and the soft protective cover 20 are constructed to be magnetically attractable to each other. In a closed position of the standing leg 40, a magnetic force between the standing leg 40 and the soft protective cover 20 is stronger than a tensile force of the spring to maintain the closed position of the standing leg 40, and in the open position of the standing leg 40, the tensile force of the spring is stronger than the magnetic force between the standing leg 40 and the soft protective cover 20 to maintain the open position of the standing leg 40. In addition, the standing leg 40 is constructed to rotate up to about a predetermined angle.

The case 10 may include a first member and the standing leg may include a second member wherein the first and second members are magnetically attractable to each other towards the closed position of the standing leg 40. The first member may be secured on a recess or an aperture formed on the soft protective cover 20 and the second member may be secured on an outer end of the standing leg 40. The first and second members inwardly face each other and are in contact with each other when the standing leg 40 is in the closed position.

The first member may be a magnet and the second member may be made of magnetically attractive metal. Alternatively, the first member may be made of magnetically attractive metal and the second member may be a magnet. The magnetically attractive metal may be steel, iron, alloy or other ferromagnetic material.

In the alternative embodiment, the case 10 may include a magnet fixedly attached to the soft protective cover 20 and the standing leg 40 may be made of magnetically attractive metal such as steel, iron, alloy or other ferromagnetic material, such that the magnet and the standing leg 40 are magnetically attractable to each other towards the closed position of the standing leg 40. The magnet may be secured on a recess formed on the soft protective cover 20.

The attractive magnetic force is strong enough to close the standing leg 40 to the closed position despite the tensile force of the spring. In addition, the spring provides enough force to open the standing leg 40 to the open position despite the magnetic force.

The standing leg 40 may be hinged on the hard protective frame 30. Alternatively, the standing leg 40 may be hinged on both of the soft protective cover 20 and the hard protective frame 30 as described above.

The spring may be a coiled spring, tension spring, helical spring, or compression spring, or the like.

Figure 13:
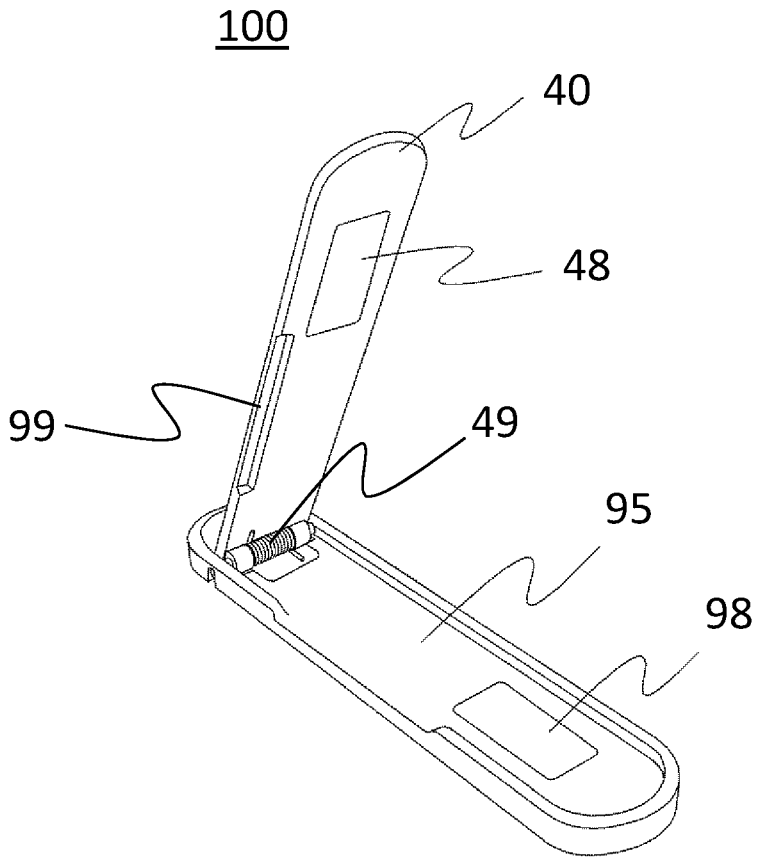
FIG. 13 shows a perspective view of the kickstand according to still another embodiment of the present invention.
Figure 14:
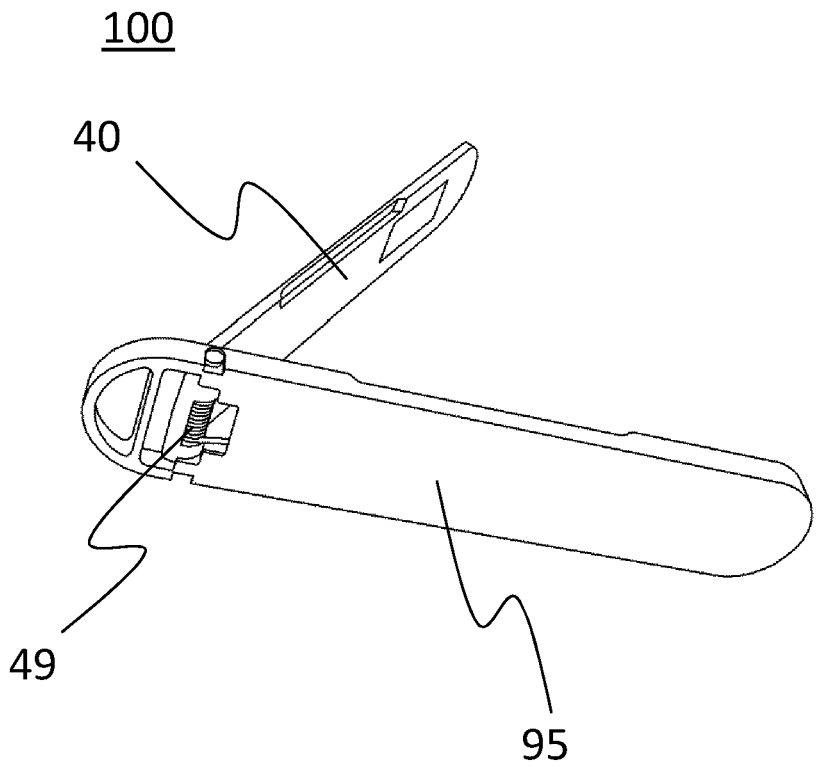
FIG. 14 shows another perspective view of the kickstand according to still another embodiment of the present invention.

In still another embodiment as shown in FIGS. 13 and 14, the case 10 may further include a standing leg base 95 wherein the standing leg 40 is hinged on the standing leg base 95 and the spring 49 biases and urges the standing leg 40 against the standing leg base 95 to the open position of the standing leg 40.

The standing leg base 95 may be secured between the soft protective cover 20 and the hard protective frame 30. Alternatively, the soft protective cover 20 may further include a recess or an aperture to receive the standing leg base 95 therein. The recess or aperture of the soft protective cover 20 may be formed on a location corresponding to the opening 50 of the hard protective frame 30, and the area of the standing leg base 95 may be slightly greater than the opening 50 formed on the back portion of the hard protective frame 30 for the standing leg 40 so that the standing leg base 95 can be secured by the edges of the opening 50 to the recess or the aperture of the soft protective cover 20 and thus, the standing leg base 95 does not come out through the opening 50 of the hard protective frame 30.

The hard protective frame 20 may have a recess formed around the opening 50 to receive edges of the standing leg base 95 such that the standing leg base 95 does not come out through the opening 50 of the hard protective frame 30. The area of the standing leg base 95 is slightly greater than the opening 50 formed on the back portion of the hard protective frame 30 for the standing leg 40 so that the standing leg base 95 can be secured by the edges of the opening 50 and thus, the standing leg base 95 does not come out through the opening 50 of the hard protective frame 30.

Thus, the case 10 having a standing leg 40 for an electronic device, includes: a soft protective cover 20 for protecting the electronic device installed therein, covering a back portion of the electronic device; a hard protective frame 30, constructed to removably mount over the soft protective cover 20; a kickstand 100 which comprises a standing leg 40 for propping up the electronic device, a spring 49 and a standing leg base 95 wherein the standing leg 40 is hinged on the standing leg base 95 and the spring 49 biases the standing leg 40 to an open position of the standing leg 40; and an opening 50 formed on a back portion of the hard protective frame 30 wherein the kickstand 100 fits in the opening 50. The standing leg 40 and the standing leg base 95 are constructed to be magnetically attractable to each other. In a closed position of the standing leg 40, a magnetic force between the standing leg 40 and the standing leg base 95 is stronger than a tensile force of the spring 49 to maintain the closed position of the standing leg 40, and in the open position of the standing leg 40, the tensile force of the spring 49 is stronger than the magnetic force between the standing leg 40 and the standing leg base 95 to maintain the open position of the standing leg 40. Additionally, the standing leg 40 is constructed to rotate up to about a predetermined angle.

The standing leg 40 is constructed to be magnetically attractable toward a direction of the standing leg base 95 to the closed position of the standing leg 40.

The standing leg base 95 may include a first member 98 and the standing leg 40 may further include a second member 48 wherein the first and second members 98, 48 are magnetically attractable to each other towards the closed position of the standing leg 40.

The first member 98 may be secured on a recess formed on the standing leg base 95 as shown in FIG. 13 and the second member 48 may be secured on an outer end of the standing leg 40, wherein the first and second members 98, 48 inwardly face each other and are in contact with each other when the standing leg 40 is in a closed position.

The first member 98 may be a magnet and the second member 48 may be made of magnetically attractive metal. Alternatively, the first member 98 may be made of magnetically attractive metal and the second member 48 may be a magnet. Magnetically attractive metal includes steel, iron, alloy or other ferromagnetic material.

In the alternative embodiment, the standing leg base 95 may include a magnet 98 and the standing leg 40 may be made of a magnetically attractive metal such as steel, iron, alloy or other ferromagnetic material, wherein the magnet 98 and the standing leg 40 are magnetically attractable to each other towards the closed position of the standing leg 40. The magnet 98 may be secured on a recess formed on the standing leg recess as in FIG. 13.

A finger insert space 99 may be formed near or about side or outer end of the standing leg 40 so that a user can insert his finger or finger nail into the finger insert space 99 to open the standing leg 40.

The spring 49 may be a coiled spring, tension spring, helical spring, or compression spring, or the like.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A case having a standing leg for an electronic device, comprising:

a soft protective cover for protecting the electronic device installed therein, covering a back portion of the electronic device;

a hard protective frame, constructed to removably mount over the soft protective cover;

a standing leg for propping up the electronic device; and an opening formed on a back portion of the hard protective frame wherein the standing leg fits in the opening, wherein the standing leg and the soft protective cover are constructed to be magnetically attractable to each other, wherein the standing leg is constructed to rotate up to about a predetermined angle.

2. The case of claim 1, further comprising a spring for biasing the standing leg to an open position of the standing leg, wherein in a closed position of the standing leg, a magnetic force between the standing leg and the soft protective cover is stronger than a tensile force of the spring to maintain the closed position of the standing leg, wherein in the open position of the standing leg, the tensile force of the spring is stronger than the magnetic force between the standing leg and the soft protective cover to maintain the open position of the standing leg, wherein the case comprises a shaft wherein the spring is positioned about the shaft.

3. The case of claim 2, wherein the spring is a coiled spring, tension spring, helical spring, or compression spring.

4. The case of claim 1, wherein the case further comprises a first member fixedly attached to the soft protective cover and the standing leg further comprises a second member wherein the first and second members are magnetically attractable to each other towards the closed position of the standing leg.

5. The case of claim 4, wherein the first member is secured on a recess or an aperture formed on the soft protective cover and the second member is secured on the standing leg, wherein the first and second members are in contact with each other in the closed position of the standing leg.

6. The case of claim 4, wherein the first member is a magnet and the second member is made of magnetically attractive metal.

7. The case of claim 4, wherein the first member is made of magnetically attractive metal and the second member is a magnet.

8. The case of claim 1, wherein the case further comprises a magnet fixedly attached to the soft protective cover and the standing leg is made of magnetically attractive metal so that the magnet and the standing leg are magnetically attractable to each other towards the closed position of the standing leg.

9. The case of claim 1, wherein the standing leg is hinged on the hard protective frame.

10. The case of claim 1, wherein the standing leg is hinged on the soft protective cover and the hard protective frame.

11. A case having a standing leg for an electronic device, comprising:

a soft protective cover for protecting the electronic device installed therein, covering a back portion of the electronic device;

a hard protective frame, constructed to removably mount over the soft protective cover;

a kickstand which comprises a standing leg for propping up the electronic device, a spring and a standing leg base wherein the standing leg is hinged on the standing leg base and the spring biases the standing leg to an open position of the standing leg; and an opening formed on a back portion of the hard protective frame wherein the kickstand fits in the opening, wherein the standing leg and the standing leg base are constructed to be magnetically attractable to each other, wherein in a closed position of the standing leg, a magnetic force between the standing leg and the standing leg base is stronger than a tensile force of the spring to maintain the closed position of the standing leg, wherein in the open position of the standing leg, the tensile force of the spring is stronger than the magnetic force between the standing leg and the standing leg base to maintain the open position of the standing leg, wherein the standing leg is constructed to rotate up to about a predetermined angle.

12. The case of claim 11, wherein the kickstand is secured between the soft protective cover and the hard protective frame.

13. The case of claim 11, wherein the soft protective cover further comprises a recess or an aperture to receive the kickstand therein.

14. The case of claim 13, wherein the recess or aperture of the soft protective cover is formed on a location corresponding to the opening of the hard protective frame, wherein the area of the standing leg base is slightly greater than the opening formed on the back portion of the hard protective frame such that the standing leg base can be secured by edges of the opening to the recess or the aperture of the soft protective cover and thus, the standing leg base does not come out through the opening of the hard protective frame.

15. The case of claim 11, wherein the hard protective frame further comprises a recess formed around the opening to receive edges of the standing leg base, and an area of the standing leg base is slightly greater than the opening so that the standing leg base can be secured by the edges of the opening and the standing leg base does not come out through the opening of the hard protective frame.

16. The case of claim 11, wherein the standing leg base comprises a first member and the standing leg further comprises a second member wherein the first and second members are magnetically attractable to each other towards the closed position of the standing leg.

17. The case of claim 16, wherein the first member is secured on a recess formed on the standing leg base and the second member is secured on the standing leg, wherein the first and second members are in contact with each other in the closed position of the standing leg.

18. The case of claim 16, wherein the first member is a magnet and the second member is made of magnetically attractive metal.

19. The case of claim 16, wherein the first member is made of magnetically attractive metal and the second member is a magnet.

20. The case of claim 11, wherein the standing leg base further comprises a magnet and the standing leg is made of magnetically attractive metal so that the magnet and the standing leg are magnetically attractable to each other towards the closed position of the standing leg.

* * * * *